US007464436B2

(12) United States Patent
Malinen

(10) Patent No.: US 7,464,436 B2
(45) Date of Patent: Dec. 16, 2008

(54) CENTRAL VACUUM CLEANER AND ITS CENTRAL UNIT

(75) Inventor: Timo Malinen, Masala (FI)

(73) Assignee: KP-Tekno Oy, Marsala (FI)

( * ) Notice: Subject to any disclaimer, the term of this patent is extended or adjusted under 35 U.S.C. 154(b) by 619 days.

(21) Appl. No.: 10/525,358

(22) PCT Filed: Sep. 1, 2003

(86) PCT No.: PCT/FI03/00638

§ 371 (c)(1),
(2), (4) Date: Feb. 23, 2005

(87) PCT Pub. No.: WO2004/019745

PCT Pub. Date: Mar. 11, 2004

(65) Prior Publication Data

US 2005/0241099 A1 Nov. 3, 2005

(30) Foreign Application Priority Data

Sep. 2, 2002 (FI) ..... 20020361 U
Sep. 2, 2002 (FI) ..... 20021563

(51) Int. Cl.
*A47L 5/38* (2006.01)

(52) U.S. Cl. ..... 15/314; 15/327.6; 15/315

(58) Field of Classification Search ..... 15/314, 15/353, 327.1, 327.6, 319; 55/334, DIG. 3, 55/DIG. 8

See application file for complete search history.

(56) References Cited

U.S. PATENT DOCUMENTS

| | | | | |
|---|---|---|---|---|
| 5,274,878 | A * | 1/1994 | Radabaugh et al. | 15/314 |
| 5,296,908 | A * | 3/1994 | Hatano et al. | 399/363 |
| 6,182,327 | B1 * | 2/2001 | Gosselin | 15/315 |
| 7,080,425 | B2 * | 7/2006 | Smith et al. | 15/327.6 |
| 2005/0241099 | A1 * | 11/2005 | Malinen | 15/314 |

FOREIGN PATENT DOCUMENTS

| | | |
|---|---|---|
| FI | 842038 | 5/1984 |
| FI | 893732 | 2/1991 |
| SE | 9003125-3 | 10/2001 |
| WO | WO98/32363 | 7/1998 |

* cited by examiner

*Primary Examiner*—Lee D Wilson
(74) *Attorney, Agent, or Firm*—Merchant & Gould P.C.

(57) ABSTRACT

A central vacuum cleaner including a central unit provided with a suction joint and an exhaust joint as well as a suction hose. According to the invention, the central vacuum cleaner includes an operating unit (1) having adaptors for attaching the central unit (2) to the operating unit, an exhaust junction (3) for connecting the exhaust joint of the central unit to the operating unit, a filter (4) for filtering the air flow from the exhaust joint and exhaust junction, as well as an outlet port (5) for directing the air flow that travelled through the filter into the air space surrounding the operating unit.

7 Claims, 4 Drawing Sheets

CENTRAL VACUUM CLEANER AND ITS CENTRAL UNIT

Figure 1:
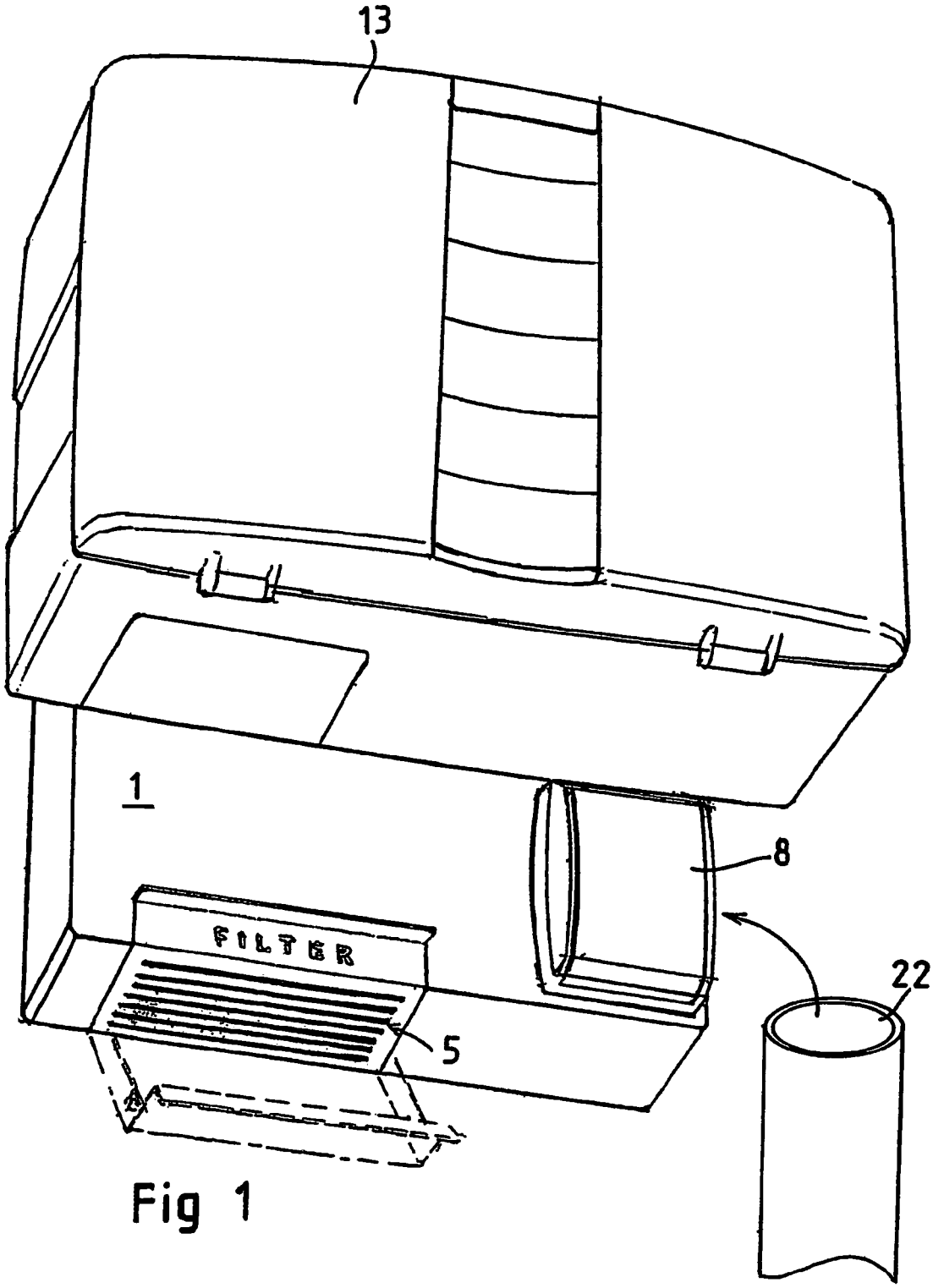

The invention relates to a central vacuum cleaner as defined in the preamble of claim 1 and to a central unit of a central vacuum cleaner.

Central vacuum cleaners are traditionally used in detached houses, and bigger central vacuum cleaning systems are used in big public premises such as hotels, hospitals, ships etc. The present invention relates mainly to smaller, flat-specific central vacuum cleaning applications.

The central vacuum cleaner includes a central unit having a motor, a fan, a dust separator such as a cyclone or some other filter, as well as a dust container. Furthermore, there is in the central vacuum cleaner a suction piping with suction boxes built according to the dimensions of the premises, as well as a suction hose to be optionally connected to the suction boxes. It is even possible that in small premises, the suction hose is directly connected to the central unit with no need for a separate suction piping. There is an exhaust pipe leading from the central unit into the yard, into which the air flow purified from most of the dust is blown.

The system as described above is very functional, cleans the air and is easy to use in private houses and terraced houses, i.e. in flats where all the functions are substantially flat-specific. Instead, in blocks of flats even the laying of the suction piping as a retro instalment would be laborious. Another disadvantage would be associated with the exhaust pipes, which the wall of a high house would be full of. Thus, the exhaust pipe would always be in the vicinity of a neighbour's windows, so that the circulation of the dusty air from one flat to another could not be avoided. Furthermore, if air is strongly blown out of the flats in blocks of flats which have a common exhaust air system, the air circulation gets into disorder, and odours and smokes flow from one room to another. These are considerable reasons for the fact of why central vacuum cleaners are not general in blocks of flats, not at least as retro instalments.

Traditionally, the central units of central vacuum cleaners have been upright cylindrical containers in which on top there is a motor, underneath it the blade structures of the fan and underneath it the separator part in which the dust is separated from the air flow by means of the centrifugal force and filters. Underneath the separator part there is a dust container in which the impurities settle as the air flow leaves sideways the area of the separator part.

Known structures are functional per se but bulky and barrel-like in respect of their appearance and taking up too much space. Due to this, their instalment in the premises is often cumbersome, and they take up too much space in a cleaning cupboard or storeroom. Likewise, their power requirement with respect to the attained suction power is relatively poor, so one must use in them quite effective motors.

The objective of the invention is to eliminate the disadvantages referred to above. One specific objective of the invention is to disclose a new type of central vacuum cleaning solution which allows the instalment and use of the central vacuum cleaner for each flat specifically in any premises. Further, the objective of the invention is to disclose a new type of central unit of a central vacuum cleaner that as being structurally novel but functionally old enables more versatile and less space-taking operating applications. Still further, the objective of the invention is to improve the suction power of the central vacuum cleaners without increasing the power of the motors being used.

As for the features characteristic of the invention, reference is made to them in the claims.

The central vacuum cleaner in accordance with the invention comprises a suction hose and a central unit provided with an exhaust joint and having a motor, a fan, a dust container, a filter and a suction joint for attaching the suction hose directly or by means of the suction piping and an exhaust joint for leading the air flow out of the central unit. According to the invention, the central vacuum cleaner comprises an operating unit separate from the central unit but attachable to it that has adapters for attaching the central unit to the operating unit, an exhaust junction for attaching the exhaust joint of the central unit to the operating unit, an additional filter for filtering the air flow coming via the exhaust joint and the exhaust junction, as well as an outlet port for directing the air flow that travelled through the filter into the surrounding air space.

Thus, characteristic of the operating unit is that the central unit of the central vacuum cleaner can be functionally attached to it in such a manner that, after an efficient cleaning, the air can be circulated back into the room space out of which it was sucked. The structure of the operating unit, and especially its size and appearance can vary even to a great extent according to the spaces and especially according to the size and shape of the central unit attached to it.

Advantageously, the central unit includes a suction junction for attaching the suction joint, of the central unit to the operating unit. In that case, there is in the operating unit preferably a suction box in connection with the suction junction, to which the suction hose can be attached. In this way, the operating unit together with the central unit attached to it forms a central vacuum cleaning system in which the suction hose is attached to the operating unit, and the exhaust air comes out of the outlet port of the operating unit. Furthermore, advantageously, arranged in the suction box of the operating unit is a control switch of the central unit, so that opening the suction box or connecting the hose to the suction box will start the motor of the central unit. Naturally the starting can also be performed using the switch in the handle of the hose. In this way, both the control and use of the whole vacuum cleaning system are performed via the operating unit while the air flow just circulates from the operating unit, to the central unit and back to the operating unit.

Advantageously, the operating unit includes a frame component having suspension means for mounting the operating unit on the wall. Depending on the shapes and structures of the operating unit and of the central unit, it is naturally also possible that the central unit is mounted e.g. on the wall and the operating unit is supported on the central unit.

The adapters with which the operating unit is attached to the central unit may vary for each case specifically. The adapters may be suspension elements, bolts or the like by means of which the central unit is attached to the operating unit, or they may be supporting elements such as supporting surfaces by means of which the central unit is supported on the operating unit. It is even possible that the exhaust junction and exhaust joint as well as the suction junction and suction joint are just connected to one another tightly and rigidly enough to allow them to support the central unit, in which case no other adaptor or suspension are needed.

The central unit of a central vacuum cleaner in accordance with the invention comprises a motor with its fans, a dust container, as well as an inlet port and outlet port for directing the air flow through the central unit. According to the invention, the dust container having an openable cover and the motor with the fans are arranged side by side in the direction of the air flows in such a manner that the cover forms a substantial part of the air flow channel between the dust container and the motor. Thus, in the structure in accordance with the invention, the air flows in the area of the dust container and the motor are substantially parallel but substantially antiparallel in such a manner that the air flow turns back to the incoming direction by action of the air flow channel defined by the cover.

Substantial in this structure is also that as the cover forms a considerable part of the air channel, the achieved flow channel is as big as possible in respect of its cross-section, and also the flow resistances are low. One has also managed to keep the device dimensions small, which would not have been possible if separate air ducts had to be formed inside the central unit.

Advantageously, the central unit is substantially a component having the form of a rectangular parallelepiped in which the dust container and the motor with the fans are disposed under the openable cover. In this way, the cover forms one side of the component as a whole, and thus at the same time forms an air flow channel as wide as possible while directing and turning the air flow from the dust container to the motor with flow resistances as low as possible.

Advantageously, the cover almost entirely forms the surface defining the flow channel outwards, but suitably, in the inner surface of the cover, guide flanges or the like elements directing the air to the desired direction are used for directing the air flow as non-turbulently as possible and with low flow resistances towards the motor and the fan.

Advantageously, the suction and air blast flows of the motor are substantially axial and perpendicular to the cover. In the same manner, advantageously, the inlet and outlet port of the air flow are disposed on opposite sides in relation to the central unit.

The central vacuum cleaner and central unit of the central vacuum cleaner in accordance with the invention have significant advantages compared to the prior art. The operating unit having a relatively simple structure enables the use of the same central unit both as a traditional out-blasting solution and as one circulating the air in interior spaces. This is how manufacturing series bigger than before and lower production costs are enabled. Since in small flats in blocks of flats, no separate suction piping is needed but just a sufficiently long suction hose, the solution in accordance with the invention allows an easy and cost-effective vacuum cleaning solution using just the operating unit mounted e.g. on the wall of a wardrobe. When, in addition, in the operating unit, sufficiently effective filters are used, the system can even be used to circulate and clean indoor air e.g. during the inconvenient pollen period. Furthermore, the structure of the central unit deviating from a traditional one and the placement of the components with respect to one another enable one to achieve a small-sized central unit, easy to install even in confined spaces. Also the emptying of the dust container of the central unit is easy just by opening the cover and emptying the dust container or dust bag. According to the tests carried out, a 20 to 30% bigger suction power can be achieved with, the novel structure of the central unit in accordance with the invention compared to the traditional central units.

Figure 2:
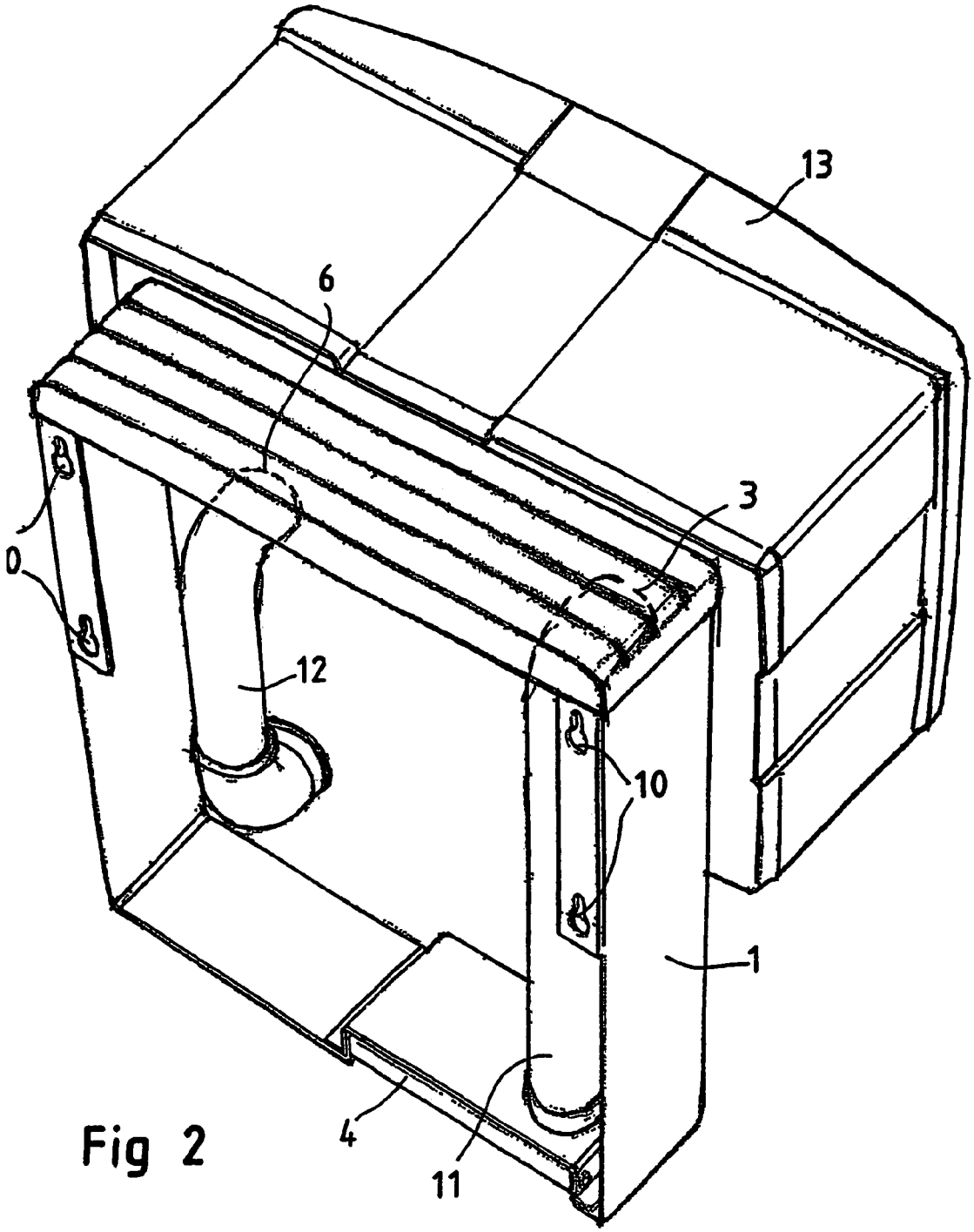
Figure 3:
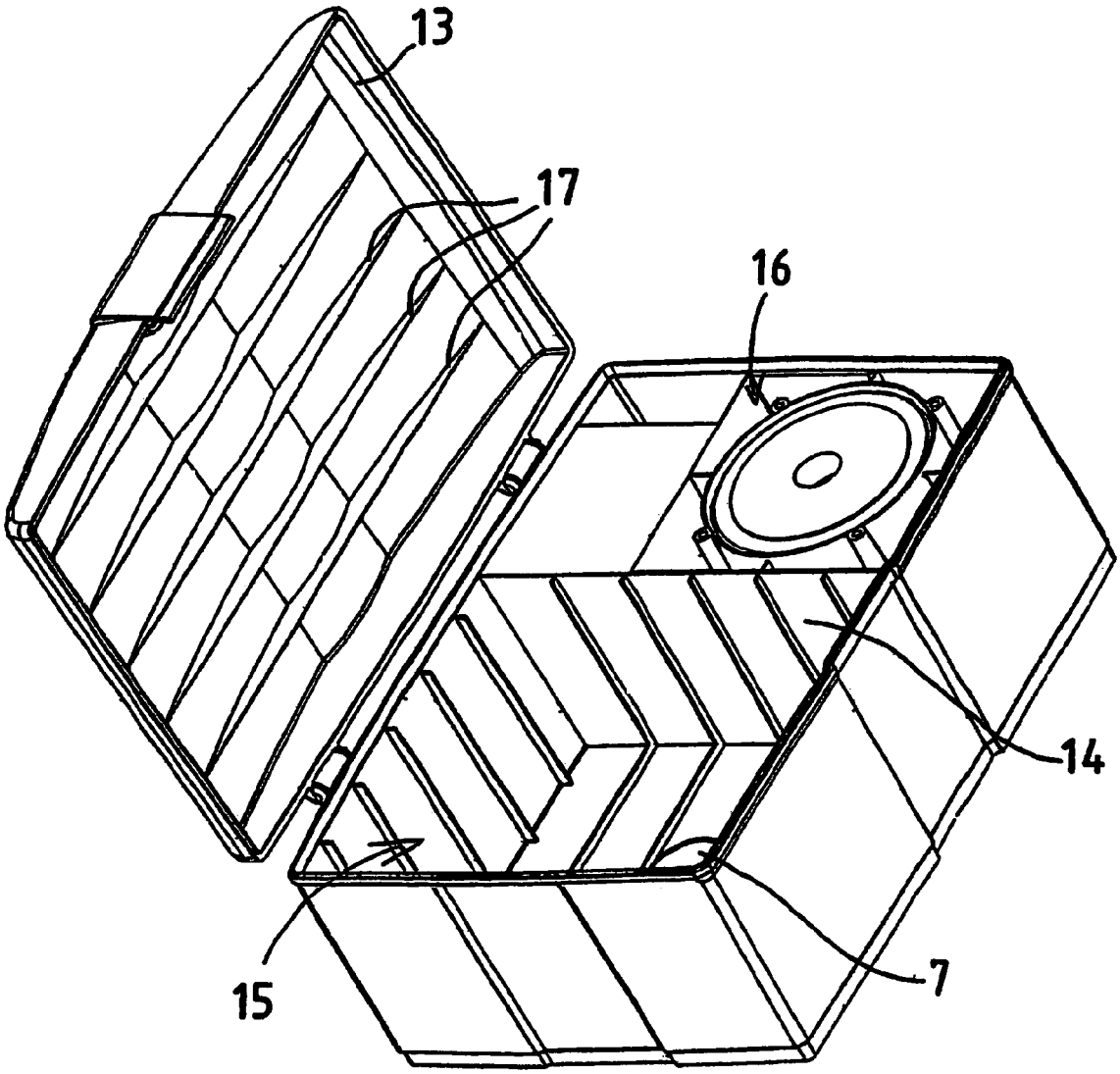
Figure 4:
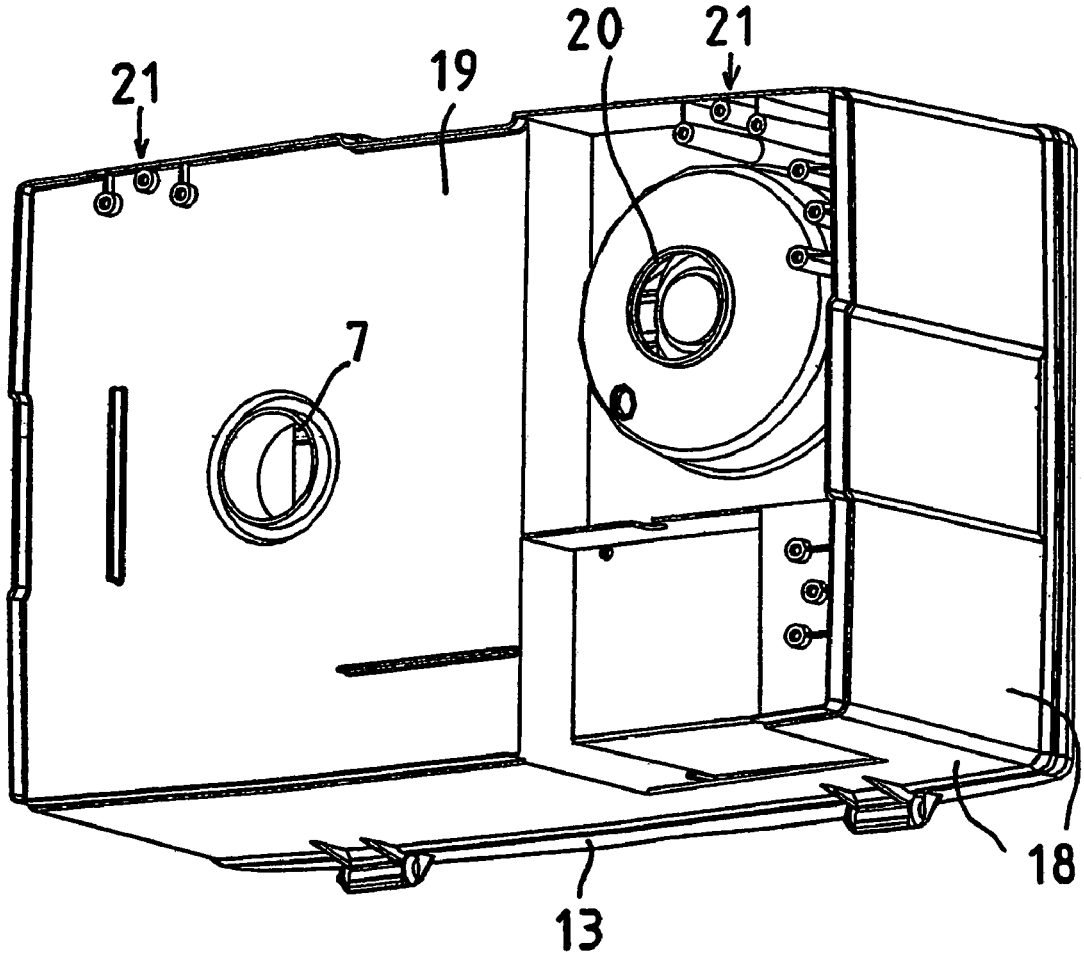

In the following section, the invention is described in detail with reference to the accompanying drawings, wherein FIG. 1 is a schematic front view illustrating the operating unit in accordance with the invention with the central unit being attached, FIG. 2 is a rear view illustrating the central unit of FIG. 1 with the central unit being attached, FIG. 3 illustrates the central unit in accordance with the invention to be used in the embodiment of FIGS. 1 and 2 with the cover open; and FIG. 4 is a rear view of the central unit of FIG. 3.

The operating unit 1 as shown in FIGS. 1 and 2 comprises a sheet-like frame component having some thickness, though. On the upper edge of the frame component there are fastening holes 10, functioning as the suspension means, that enable one to mount the operating unit on the wall. On the lower side of the sheet-like frame component there is disposed an additional filter 4, near which there is on the lower edge of the frame component an outlet port 5. The outlet port is disposed in the openable cover. By opening the cover, the additional filter disposed on top of it can be changed at suitable intervals.

On top of the additional filter 4, inside the sheet-like frame component, there is an air duct 11, which starts from the front surface of the frame component from the exhaust junction 3. Correspondingly, on the front surface of the sheet-like frame component there is the one end of the pipe, i.e. suction junction 6, from which there is a second air duct 12 leading inside the frame component downwards to the front surface thereof, opening therein out of a suction box 8. To this suction box 8 it is possible to connect the suction hose of the central vacuum cleaner.

The operating unit according to FIGS. 1 and 2 has been shaped and adapted so as to be used in conjunction with a new type of central unit of a vacuum cleaner in accordance with the invention as shown in FIGS. 3 and 4. This kind of central unit is substantially a component having the form of a rectangular parallelepiped. A box-like frame is defined by four side walls 18 and a back wall 19 forming the bottom. The openable and lockable cover 13 forms the front wall of the central unit.

The inner space defined by the side walls 18 is divided with a partition 14 into two spaces, i.e. a dust container 15 and a motor space 16 having a motor with fans. In the dust container it is possible to, place a dust bag or some other corresponding filter structure that filters the dust from the flowing air.

At the bottom of the dust container 15 there is an inlet port 7 of the air flow. The air flow substantially purified from dust travels from the dust container into the motor space 16 on the other side of the partition 14 via the cover 13. On the inner surface of the cover 13 there are crosswise and straight, sheet-like guide flanges 17, which form in their gaps straight flow grooves or air ducts. Along these the air flows towards the motor space 16, wherein the motor and the fan are disposed on the same axis which is perpendicular to the back wall 19 of the central unit. On the back wall there is an outlet port 20, through which the air flow leaves the central unit. Arranged on the back wall are also fastenings 21 by means of which the central unit can be mounted on the wall or secured to some other suitable place wherein there are the pipes to be attached to the inlet port 7 and outlet port 20.

The mutual placement of the dust container and motor as well as of the fans combined with the cover structure's function directing the air flows enable a central unit of a vacuum cleaner that is easy and simple to use, which has a space requirement smaller than that of the traditional central units and which enables one to considerably increase the suction power.

The operating unit and the central unit attached to it function as follows. The central unit of the central vacuum cleaner is attached to the operating unit as shown in FIGS. 1 and 2 by connecting the suction joint 7 of the central unit to the suction junction 6 of the operating unit and the exhaust joint 20 of the central unit to the exhaust junction 3 of the operating unit. At the same time the central unit operating unit while staying firmly in place. In the suction box 8 there is in addition an electrical switch that is connected to the central unit.

When the suction box 8 is opened and the suction hose 22 is plug into the suction box, the central unit starts. In that case, the air starts to circulate from the suction box through the air duct 12 to the suction junction 6 and suction joint 7, and away from it to the dust container 15, wherein most of the dust remains in the dust bag or corresponding filter. From here the air flow proceeds towards the cover 13, turning crosswise guided by the air ducts of the cover 13, and further backwards to the motor space 16, and away from it in the axial direction of the motor and fan to the exhaust joint 20 and exhaust junction 3. From here the air flow proceeds along the air duct 11 into an additional filter 4 that is finer and more accurate than the dust bag. From the additional filter, the air flow is directed through the outlet port 5 into the air space surrounding the equipment.

The use of the whole equipment is very simple and easy; starting and stopping just by fastening and unfastening the suction hose, and the emptying and change of the dust bag just by opening the cover 13.

The operating unit in accordance with the invention can also be applied to the cylindrical central units widely used at present. Substantial is only the fact that the suction junction and exhaust junction of the central unit can be attached to the operating unit, that the air flow from the filter of the operating unit can substantially freely flow into the surrounding space, and that the dust container of the central unit can be relatively freely and easily removed for emptying. Thus, the technical operation and structure is the same irrespective of the central unit while the central unit possibly requires just a suitable central unit-specific design.

In the foregoing, the invention has been described by way of examples with reference to the accompanying drawings while various embodiments of the invention are possible within the scope of the inventive, idea defined by the claims.

The invention claimed is:

1. A central vacuum cleaner including a suction hose and a central unit having a motor, a fan, a dust container, a filter and a suction joint for attaching the suction hose either directly or by means of a suction piping, and an exhaust joint for directing the air flow out of the central unit, wherein the central unit includes an operating unit separate from the central unit, the operating unit having adaptors for attaching the central unit to the operating unit, an exhaust junction for connecting the exhaust joint of the central unit to the operating unit, an additional filter for filtering the air flow coming through the exhaust joint and exhaust junction, as well as an exhaust port for directing the air flow that travelled through the additional filter into the air space surrounding the operating unit.

2. The central vacuum cleaner according to claim 1, wherein the operating unit includes a suction junction for connecting the suction joint of the central unit to the operating unit.

3. The central vacuum cleaner according to claim 2, wherein the operating unit includes a suction box in connection with the suction junction, to which the suction hose can be attached.

4. The central vacuum cleaner according to claim 3, wherein the suction box of the operating unit includes a switch where the central unit can be started and switched off.

5. The central vacuum cleaner according to claim 1, wherein the operating unit includes a frame component having suspension means for mounting the operating unit on the wall.

6. The central vacuum cleaner according to claim 1, wherein the adaptors are suspension elements by means of which the central unit is attached to the operating unit.

7. The central vacuum cleaner according to claim 1, wherein the adaptors are supporting elements such as supporting surfaces by means of which the central unit is supported on the operating unit.

* * * * *